US007814896B2

(12) United States Patent
Chacko et al.

(10) Patent No.: US 7,814,896 B2
(45) Date of Patent: Oct. 19, 2010

(54) RANGE DESIGN FOR SURFACE TEMPERATURE CONTROL

(75) Inventors: Jacob T. Chacko, Pickerington, OH (US); Stu Garick, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1267 days.

(21) Appl. No.: 11/365,232

(22) Filed: Mar. 1, 2006

(65) Prior Publication Data

US 2006/0201493 A1 Sep. 14, 2006

Related U.S. Application Data

(60) Provisional application No. 60/657,635, filed on Mar. 1, 2005.

(51) Int. Cl.
*F24C 15/00* (2006.01)

(52) U.S. Cl. ..... 126/37 R; 126/273 R; 126/19 R

(58) Field of Classification Search ..... 126/37 R, 126/273 R, 19 R

See application file for complete search history.

(56) References Cited

U.S. PATENT DOCUMENTS 662,874 A 11/1900 Marshall et al.
1,298,358 A 3/1919 Kuhn at al.
3,081,763 A 3/1963 Newell, Jr. et al.
3,485,229 A 12/1969 Gilliom
3,624,742 A * 11/1971 Hurko et al. ..... 126/39 D
3,633,561 A 1/1972 Barnett et al.
3,911,893 A 10/1975 Baker at al.
4,041,930 A * 8/1977 Katona ..... 126/198
4,241,718 A 12/1980 Barnett
4,245,615 A 1/1981 Moss
4,311,460 A * 1/1982 Lauersdorf et al. ..... 432/247
4,370,973 A 2/1983 Bolanos
4,616,562 A 10/1986 Kuechler
4,627,409 A 12/1986 Kagomoto
4,638,615 A * 1/1987 Taylor ..... 52/364
4,848,311 A 7/1989 Dorri
4,886,042 A 12/1989 Bessler

* cited by examiner

*Primary Examiner*—Steven B McAllister
*Assistant Examiner*—Sarah Suereth
(74) *Attorney, Agent, or Firm*—MacMillan, Sobanski & Todd, LLC

(57) ABSTRACT

A kitchen range that includes a front panel, a rear panel, and a pair of opposed side panels. Each of the panels is connected to the front panel at a respective front corner. The range also includes a conduit configured to transport an airflow within the range. The opposed side panels can also include a front flange defining a channel. A channel wall is attached to each front flange. The channel wall is configured to enclose the sides of the channel to form a conduit. The conduit is configured to transport an airflow through the conduit.

10 Claims, 6 Drawing Sheets

RANGE DESIGN FOR SURFACE TEMPERATURE CONTROL

This application claims the benefit of U.S. Provisional Application 60/657,635 filed Mar. 1, 2005.

BACKGROUND OF THE INVENTION

This invention relates in general to a mechanism for controlling the temperature of a heating appliance such as a kitchen range, and more particularly relates to controlling the temperature of localized "hot spots".

It is known to make both gas and electric ranges in order to comply with numerous safety codes, specifically those established by Underwriters Laboratory (UL). Several of these codes relate to the external temperatures of side and top panels of the ranges. Since kitchen ranges are typically positioned adjacent other appliances or are built in next to cabinets, the side panels of the range are close to, or are in direct contact with these other items. It would not be advantageous if the temperature were to rise too high. Another feature creating high temperatures in many ranges made today is that the ranges are self-cleaning. A self-cleaning range incorporates several features, including the initial application of high heat at the top of the range cavity to initiate the operation of a catalytic smoke eliminator before heavy soils on the side and bottom walls are volatized. Heat is then supplied for a period of time to maintain at least a minimum required temperature in the range for pyrolysis of the soils. The heat is controlled to prevent the temperature from exceeding the operating or softening temperature of the enamel on the range liner walls while maintaining the temperature of all parts of the range liner walls within the effective self-clean temperature range.

Manufacturers have used a number of different techniques to control the self-cleaning cycle. Typically, however, range controls begin the cycle with full power applied to a broil (upper) heating unit for a fixed amount of time. At some point during the cycle some controls switch to the bake unit as the primary source of heat input, while others use the bake unit to augment the broil unit input. This may be done at full power or at reduced power. Some other manufacturers use a fixed setting cycle switch, such as a bimetal switch for example, to reduce the effective power of the heating units. Other controls use one unit, either the bake or the broil, exclusively for the heat input. In most ranges, however, a thermostat is used to call for heat when needed to satisfy the minimum requirements, and to stop heat input to keep the range liner temperature from exceeding maximum design temperature.

During a self-cleaning cycle, the temperatures within the range can reach up to, or exceed 900° F. During this self-cleaning cycle it is important to control the side and top panel temperature in order to prevent the temperature's being so excessive as to create a fire hazard, or a potential danger should there be human contact with a hot spot. Normally, such temperature controls are achieved by designing the range such that the range cavity is spaced from the side and top panels so as to leave an air gap between the cavity and the panels. Additionally, insulation is typically positioned on or near the side and top panels to further limit the heat transfer to the surfaces of the panels by either conduction or convection.

Although conventional designs have been somewhat effective to control external temperatures of ranges, it would be advantageous to provide a mechanism to control the temperature of the range, particularly in localized areas on the range, to limit or prevent the occurrence of hot spots.

SUMMARY OF THE INVENTION

This invention relates to a kitchen range that includes a front panel, a rear panel, a pair of opposed side panels, each panel connected to the front panel at respective front corners, and a conduit configured to transport an airflow within the range.

The invention also relates to a kitchen range that includes a front panel, a rear panel, and a pair of opposed side panels, each panel including a front flange defining a channel. A channel wall is attached to the front flange. The channel wall is configured to enclose the sides of the channel to form a conduit. The conduit is configured to transport an airflow through the conduit.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
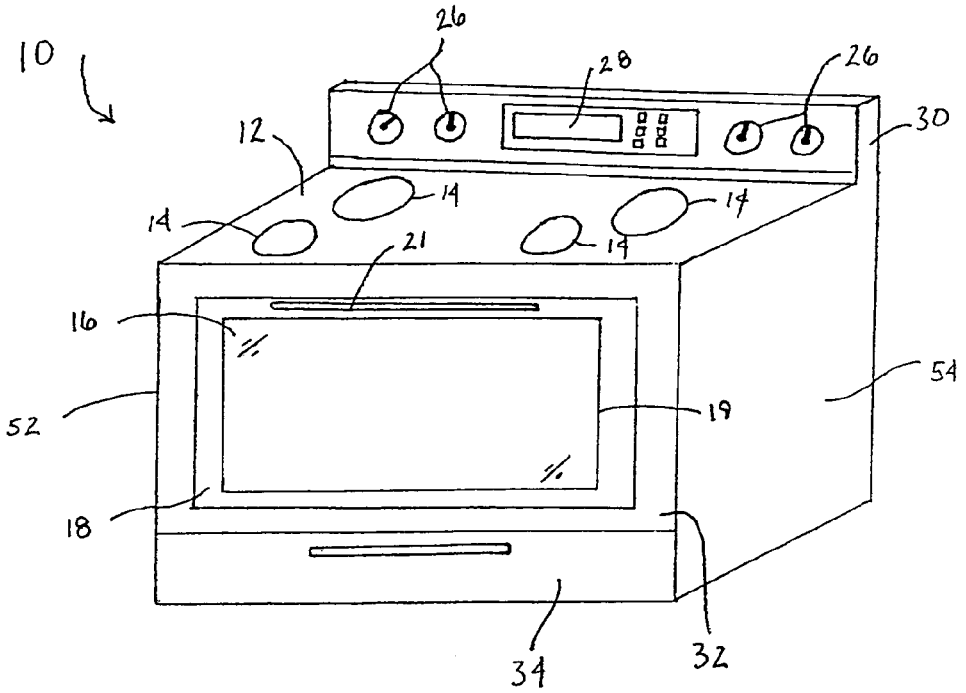
FIG. 1 is a perspective view of a free standing domestic kitchen range according to the present invention.

Referring now to the drawings, there is illustrated in FIG. 1 a perspective view of a free-standing range 10 according to the present invention as is typically found in a kitchen for residential, domestic use. Such a range 10 includes a substantially flat, top cooking surface 12, typically having a plurality of heating elements or burners 14 located thereon. The range 10 includes a plurality of controls 26 for the burners 14 on the cooking surface 12 as well as a control panel 28 for controlling the temperature within a range cavity 16. Typically, the controls 26 and control panel 28 are mounted on the backsplash 30 which is located on the back edge of the cooking surface 12. The backsplash 30 typically extends away from, and substantially perpendicular to, the cooking surface 12.

Located under the cooking surface 12 is a range liner 15 having top, bottom rear and side walls to define a range cavity 16. Shielding the range cavity 16 on the front side is a front panel 32 that includes an insulated range door 18 pivotally connected to the front panel 32. The range door 18 is conventionally hinged at a lower end so that the range door 18 can be pivoted away from the front panel 32 and the range cavity 16 such that a user can access the range cavity 16. Optionally, the range door 18 can include a window 19, typically made of glass, so that a user can view the contents of the range cavity 16 during its use. Also, the range door 18 can include a handle 21 to facilitate moving the range door 18 from an open position to a closed position and vice versa. Positioned within or around the range cavity 16 can be heating elements (not shown) for an electric range, or tubes having a plurality of ports for a gas range.

The range cavity 16, defined by the range liner 15, is also protected and supported on the sides by a pair of opposed side panels 52, 54. A back panel 24 can also be used to support and protect the range liner 15. Thus, the outer cabinet structure, comprising the side panels 52, 54, the rear panel 24, and the front panel 32, forms the supporting structure for the components of the range 10. The outer surfaces of the side panels 52, 54, the rear panel 24, and the front panel 32 typically have an aesthetically pleasing finish since all or a portion of the outer surfaces of the panels 32, 52, 54 can be seen even after the range 10 has been installed for use. As can be seen more clearly in FIG. 2, the pair of side panels 52, 54 are connected to the front panel 32 at opposite ends of the front panel 32 at respective front corners 50. The cooking surface 12 typically connects to the front panel 32 at the upper edge of the front panel 32. Positioned at a lower edge of the front panel 32, there can be a pull out tray 34 that can be used for the storage of pots, pans and other cooking utensils.

Figure 2:
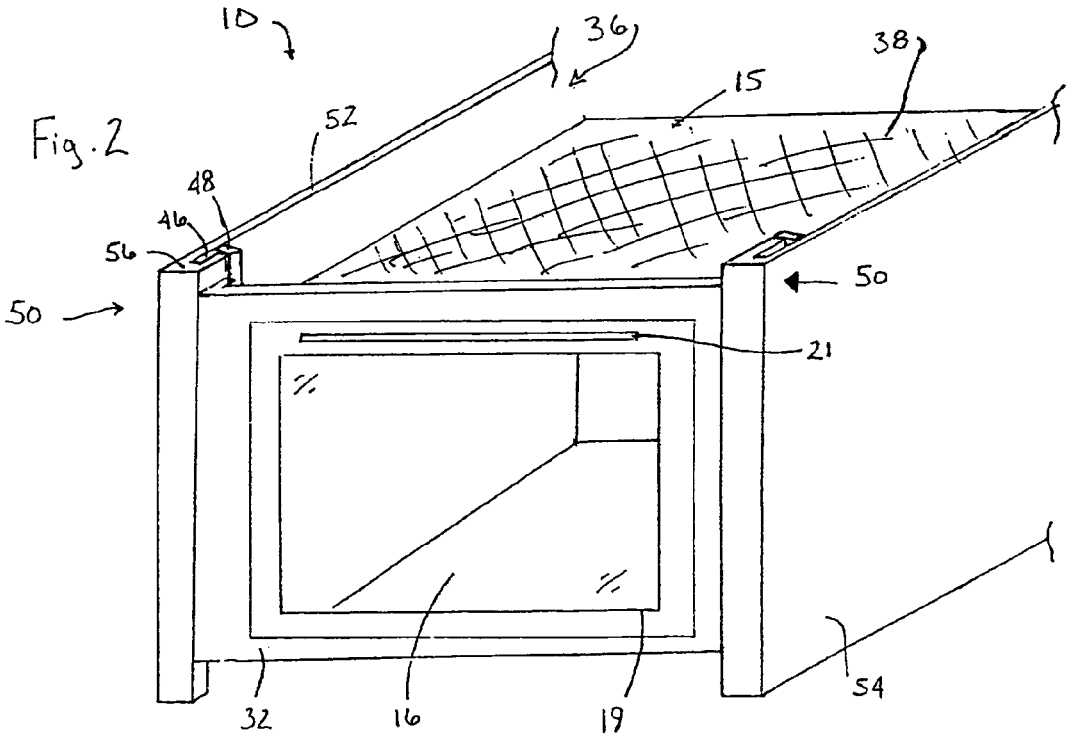
FIG. 2 is a perspective view of the range shown in FIG. 1, with portions of the range cut away.

Illustrated in FIG. 2, the range 10 of FIG. 1 is shown with portions of the range 10 removed so that the side panels 52, 54, the range liner 15, the front panel 32, and the insulation material 38 can be seen more clearly. Insulation material 38 is positioned around the range liner 15 in the space between the side panels 52, 54, the rear panel 24, and the range liner 15. The insulation material 38 serves many purposes, including retaining the heat within the range cavity 16 so as to more efficiently use the energy used to raise and maintain the temperature within the range cavity 16. A typical insulation material 38 is a fiberglass insulation placed on the outside of the range liner 15, which, as described above, defines the range cavity 16. The use of insulation material 38 also limits the amount of heat that is transferred by conduction, convection, and radiation to the surfaces of the panels 52, 54, 24. Similar insulation material 38 or an insulated guard plate (not shown) can be positioned between the range liner 15 and the cooking surface 12.

Figure 3:
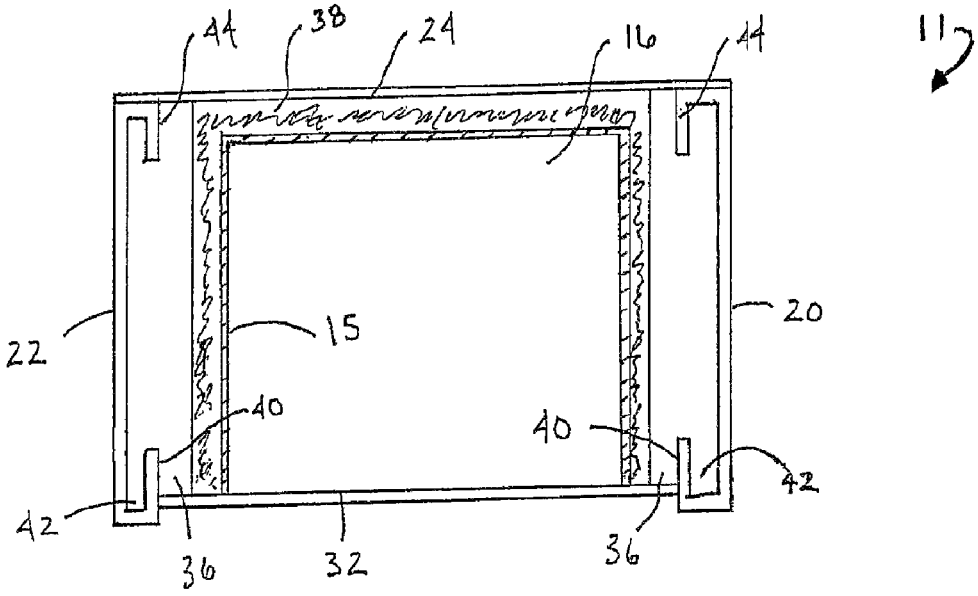
Fig. 3 (PRIOR ART)
FIG. 3 is a plan view of a prior art range similar to the range of FIG. 2.

Illustrated in FIG. 3 there is shown a prior art range 11 with the cooking surface 12 removed so that the internal components of the range 11 can be more clearly seen. It should be appreciated that the range 11 is similar to the range 10 except as described herein. As can be seen in FIG. 3 there is an air gap 36 between the insulation material 38 on the range liner 15 and the inner surfaces of opposed side panels 20, 22. Such an air gap 36 is used to limit the conductive heat transfer between the range liner 15, the insulation material, and the panels 20, 22. The use of the air gap 36 supplements the insulation 38 to minimize surface temperatures on the outer surfaces of the panels 20, 22, 24 and 32. However, as shown in the FIG. 3, the front panel 32 is directly connected to the range liner 15. Therefore, there is the potential for significant conductive heat transfer to occur between the range liner 15 and the front panel 32. Additionally, the side panels 20, 22 are directly connected to the front panel 32 at the lateral edges of the front panel 32 at a front flange 40. The front flange 40, defining a generally J-shaped channel 42, provides an attachment surface for connecting the front panel 32 to the side panels 20, 22. Typically, threaded fasteners are used as the mechanism for connecting the side panels 20, 22 to the front panel 32. Therefore, there is also the potential for conductive heat transfer between the front panel 32 and the side panels 20, 22 at that location.

Figure 4:
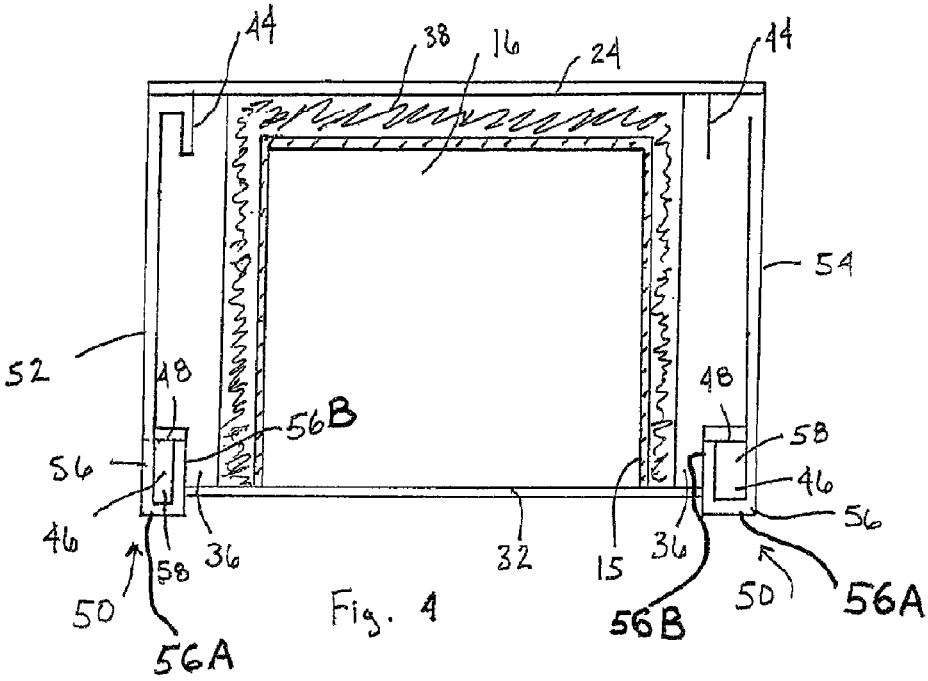
FIG. 4 is a plan view of a free standing range according to the present invention.
Figure 5:
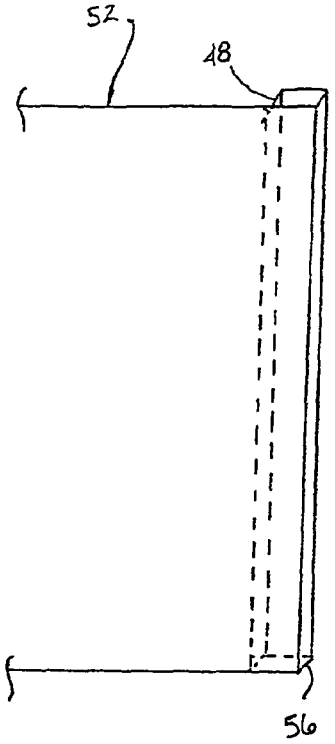
FIG. 5 is a side view of a portion of one side panel of the range shown in FIG. 1.

Illustrated in FIG. 4, the range 10 is shown as having a conduit 46 according to the present invention. Illustrated in FIG. 5, there is shown a portion of the side panel 52 separate from the range 10. Also shown in FIGS. 4 and 5 is the conduit 46 according to the invention. The side panel 52 is substantially planar along its height and width and preferably includes a front flange 56. The flange 56 can act to stiffen the panel 52 as well as provide an attachment face for connecting the side panel 52 to the front panel 32. It can be seen from FIG. 4 that the front flange 56 consists of a front flange portion 56A and an inward extension portion 56B. The side panel 52, the front flange portion 56A and the inward extension portion 56B form an open channel 58. Although the channel 58 is defined by a substantially J-shaped front flange 56, it can be appreciated that the channel 58 can have any suitable shape such as arcuate, semi-circular, or circular. As can be seen in FIG. 4, a similar rear flange 44 can be formed at the rear of the side panel 52. It should be appreciated that the side panel 54 on the opposite side of the range 10 is also formed having a similar front flange 56 defining a channel 58, and can also include a similar rear flange 44.

As can be seen more clearly in FIG. 4, a channel wall 48 substantially encloses the channel 58 (formed from the side panel 52, the front flange portion 56A and the inward extension portion 56B) to form the conduit 46. As can also be seen, a pair of conduits 46 are located at the opposed front corners 50 of the range 10 so that hot spots can be limited at both locations. The use of the conduits 46 according to the present invention facilitates a chimney effect and directs the air flow to the specific locations where it would be advantageous to reduce the surface temperature. The tendency of heated air or gas to rise in a conduit or other substantially vertical passage, such as in a chimney, due to its lower density compared to the surrounding air or gas is known as a chimney effect. Utilizing a directed chimney effect creates an air flow from along the length of the entire side panel 52, 54, and directs the air flow up towards the front corners 50 of the range 10. It should be appreciated that the conduits 46 can include apertures (not shown) at various positions along their lengths to allow air flow into or out of the conduits 46.

Figure 6:
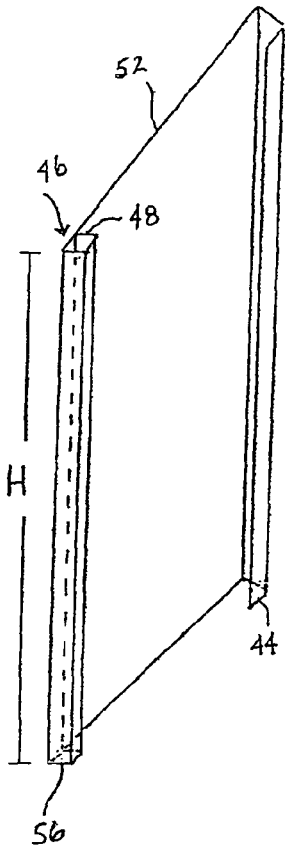
FIG. 6 is a perspective view of one side panel of the range shown in FIG. 5 according to the present invention.

Illustrated in FIGS. 5 and 6, there is shown the side panel 52 according to the present invention. Although the side panel 52 in FIGS. 5 and 6 is shown as a line drawing, it should be appreciated that the side panel 52 would have a thickness as indicated in FIGS. 2 and 4. In the present embodiment, the channel 58 is at least partially enclosed by a channel wall 48 to form the conduit 46. The channel wall 48 can be connected to the front flange 56 using any suitable mechanism. The mechanism used to connect the channel wall 48 to the front flange 56 could vary depending on the material of which the channel wall 48 is made. For example, the connecting mechanism can include tape, threaded fasteners, rivets, welding, glue, interlocking parts, and press fitting, or any other suitable mechanism. In the preferred embodiment, the channel wall 48 encloses the front flange 56 so as to close the channel 58 and define the substantially hollow conduit 46. The channel wall 48 can have any desired length, thereby creating a conduit 46 having any desired length. In the preferred embodiment, the length of the channel wall 48 is such that the conduit 46 extends the majority of the overall height, H, of the side panel 52. At the lower (floor) end of the conduit 46, there is preferably an opening (not shown) such that air can enter the conduit 46 therein and flow upwards towards the upper corners where the side panel 52 intersects the front panel 32, and the cooking surface 12. It should be appreciated that the opposite side panel 54 is preferably formed having a similar construction.

Figure 7:
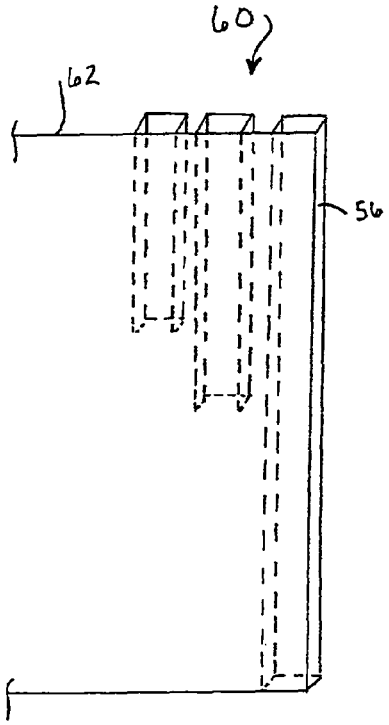
FIG. 7 is a side view of a side panel of a range according to an alternate embodiment of the invention.

In an alternate embodiment of the invention, shown in FIG. 7, a plurality of conduits 60 can be formed in a side by side manner along the lengths of a side panel 62. Although only one such side panel 62 is shown in FIG. 7, it should be appreciated that such a construction can be used on any of the side panels described above. In such a manner, an air flow can be created along the length of the side panel 62. The overall lengths of the plurality of conduits 60 can be the same, or can vary as a function of the distance away from the front corner 50 of the range 10. This would accomplish achieving a maximum amount of airflow at the front corner 50, where the side panel 62 and the front panel 32 intersect, and providing a lesser amount of airflow (reduced chimney effect) from the bottom of the range 10 towards the top of the range 10 when moving further away from the front corner 50 towards the rear panel 24 of the range 10. Alternatively, depending on the exact locations of hot spots on the range 10, the lengths of the conduits 60 could be different as desired to create a specific type of airflow at those particular locations. It should also be appreciated that adjacent conduits 60, such as those seen in FIG. 7, could be positioned directly adjacent each other, or could be spaced apart along the length of the side panel 62. Although the conduits 46, 60 are shown having a substantially vertical orientation, the conduits 60 could be positioned at any (non-vertical) angle. It should also be appreciated that conduits 46, 60 could be positioned along the rear panel 24 as well if so desired.

Any of the conduits 46, 60 described above can be formed using any suitable materials. For example, the channel wall 48 can be made from aluminum, aluminum foil, or any other metal foil. Using such a material is a relatively inexpensive way to create the conduit 46, 60. Additionally, using a metal foil or a strip of a similar thin material could be easily attached to the front flange 56 to form the conduit 46, 60. The materials listed herein have an inherent reflective quality. The use of a material having a greater reflectivity could impact the performance of the conduit in that a more reflective material might reflect heat away from the side panel better than a less reflective material. It should be appreciated that the front flange 56 could also act as the channel wall 48 as well as serving as the front flange 56. In such an embodiment, the flange 56 would be formed such that it is a continuous flange member that is wrapped around to form a complete conduit 46, 60 rather than forming a J-shaped channel as was described above. In another embodiment, the channel 58 could be formed using any metal or high temperature plastic that could be attached to the front flange 56 and the side panels 52, 54, 62. Additionally, the channel wall 48 could be a separate metal or plastic member that is wedged into position between the front flange 56 and any of the side panels 52, 54, 62. Thus, the channel wall 48 could be retained by a frictional fit. It should be appreciated that the conduit 46 could also be formed as a separate hollow tubular member that is subsequently attached to the side panel 52, 54, 62 at any location using any suitable attachment mechanism such as welding, fasteners, tape, etc.

It should also be appreciated that the upper and lower ends of the conduits 46, 60 can be configured to allow the creation of an air flow path. Therefore, the lower end of each conduit 46, 60 can have one opening or a plurality of openings to allow air to enter the conduits 46, 60. Additionally, the upper end of each conduit 46, 60 can include an opening or a plurality of openings to allow the air to escape through vents or other openings formed on the front panel 32, the side panels 52, 54, 62, or the cooking surface 12.

EXAMPLES

Figure 8:
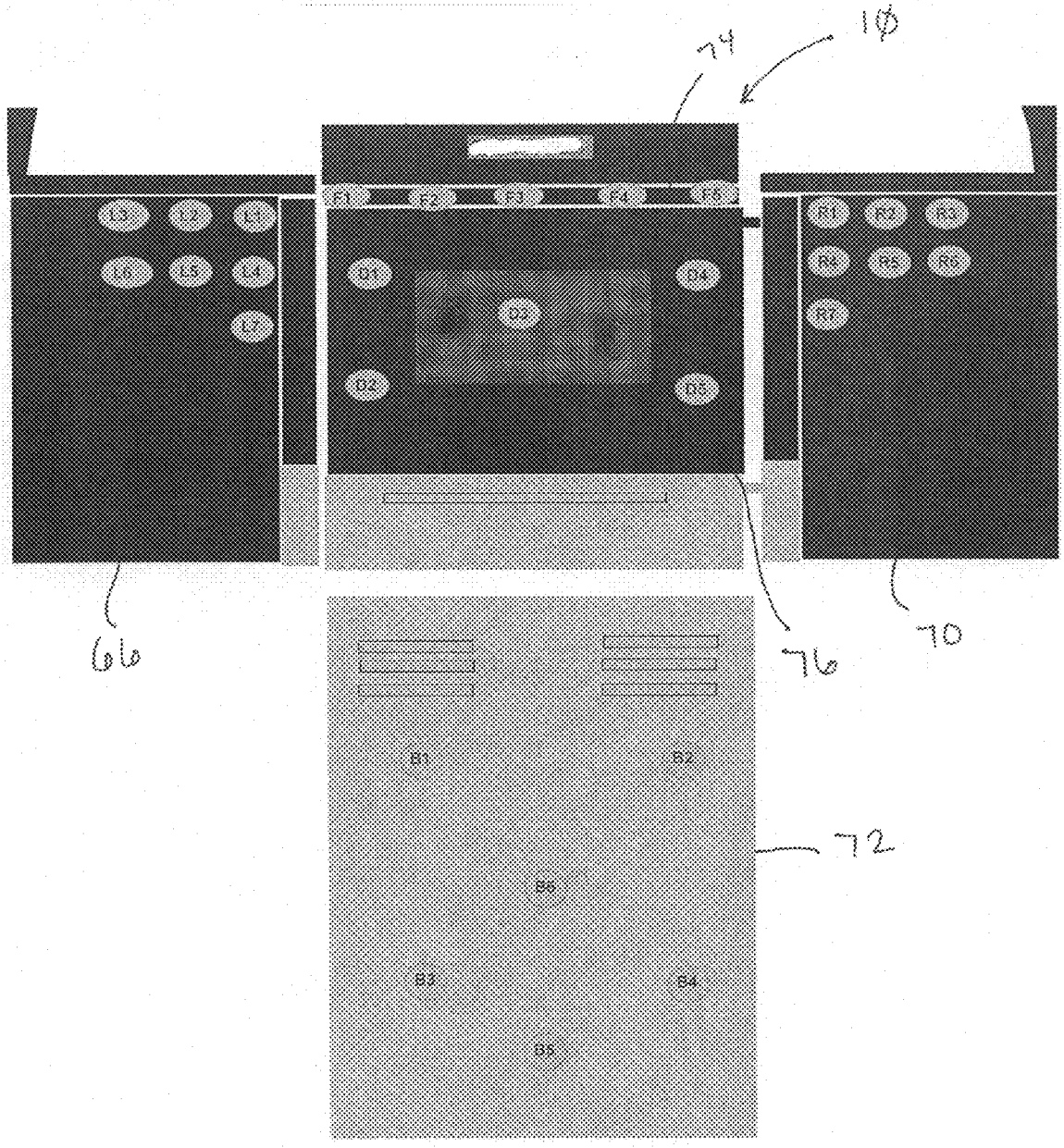
FIG. 8 is a plan view of the free stranding range according to the present invention.

FIG. 8 shows the self standing range 10 of the present invention. Temperature readings were taken at the zones indicated as shown in FIG. 8 at left side 66 of range 10 at L1, L2, L3, L4, L5, L6 and L7; the right side 70 of range 10 at R1, R2, R3, R4, R5, R6 and R7; the front 74 of the range 10 at F1, F2, F3, F4, and F5; the range door 76 at D1, D2, D3, D4 and D5 and the back 72 of the range 10 at B1, B2, B3, B4, B5 and B6. Temperature readings on two zones, BT1 and BT2 (not shown), on the bottom of the range.

Table 1 depicts temperature readings for the zones indicated above.

TABLE 1

| | Insulation Type | | | | | |
|---|---|---|---|---|---|---|
| | TRS-40* | TRS-40* | | TRS-50* | TRS-50* | |
| | Set Point | | | | | |
| | w/chimney effect | w/o chimney effect | | w/chimney effect | w/o chimney effect effect | |
| | Thickness (inches) | | | | | |
| | 1.5 | 1.5 | | 1.5 | 1.5 | |
| | Oven Temp. (° F.) | | | | | |
| | 869 | 870 | | 865 | 867 | |
| | Room Temp. (° F.) | | | | | |
| | 74 | 74 | | 70 | 70 | |
| | Thermocouple (TC)/Probe | | | | | |
| Temp Location | TC Temp (° F.) w/chimney effect | TC Temp (° F.) w/o chimney effect effect | Difference | TC 1½ hrs. | TC 1½ hrs. | Difference |
| L1 | 159 | 169 | −11 | 155 | 165 | −9 |
| L2 | 161 | 163 | −2 | 153 | 152 | 0 |
| L3 | 147 | 148 | −1 | 139 | 140 | −1 |
| L4 | 147 | 155 | −8 | 149 | 155 | −6 |
| L5 | 119 | 118 | 1 | 110 | 110 | 0 |
| L6 | 109 | 110 | −1 | 102 | 103 | −1 |
| L7 | 133 | 134 | −1 | 132 | 137 | −5 |
| R1 | 158 | 164 | −6 | 153 | 161 | −8 |
| R2 | 149 | 151 | −1 | 146 | 147 | −1 |
| R3 | 141 | 144 | −3 | 138 | 141 | −3 |

TABLE 1-continued

| | Insulation Type | | | | | |
|---|---|---|---|---|---|---|
| | TRS-40* | TRS-40* | TRS-50* | TRS-50* | | |
| | Set Point | | | | | |
| | w/chimney effect | w/o chimney effect | w/chimney effect | w/o chimney effect effect | | |
| | Thickness (inches) | | | | | |
| | 1.5 | 1.5 | 1.5 | 1.5 | | |
| | Oven Temp. (° F.) | | | | | |
| | 869 | 870 | 865 | 867 | | |
| | Room Temp. (° F.) | | | | | |
| | 74 | 74 | 70 | 70 | | |
| | Thermocouple (TC)/Probe | | | | | |
| Temp Location | TC Temp (° F.) w/chimney effect | TC Temp (° F.) w/o chimney effect effect | Difference | TC 1½ hrs. | TC 1½ hrs. | Difference |
| R4 | 157 | 150 | 7 | 152 | 153 | −1 |
| R5 | 111 | 110 | 1 | 110 | 110 | 0 |
| R6 | 102 | 103 | −1 | 101 | 102 | −1 |
| R7 | 138 | 138 | 0 | 129 | 136 | −7 |
| F1 | 159 | 161 | −2 | 159 | 158 | 1 |
| F2 | 170 | 174 | −4 | 173 | 167 | 5 |
| F3 | 185 | 188 | −3 | 179 | 181 | −1 |
| F4 | 159 | 162 | −3 | 157 | 168 | −11 |
| F5 | 146 | 148 | −1 | 143 | 147 | −4 |
| D1 | 140 | 141 | 0 | 138 | 140 | −2 |
| D2 | 112 | 113 | 0 | 111 | 113 | −2 |
| D3 | 173 | 173 | 0 | 170 | 172 | −2 |
| D4 | 140 | 140 | 0 | 138 | 140 | −2 |
| D5 | 112 | 112 | 1 | 109 | 110 | −1 |
| B1 | 153 | 163 | −10 | 168 | 170 | −2 |
| B2 | 167 | 179 | −12 | 176 | 176 | 1 |
| B3 | 170 | 176 | −6 | 176 | 176 | −1 |
| B4 | 173 | 182 | −10 | 178 | — | — |
| B5 | 164 | 176 | −12 | 172 | 172 | 1 |
| B6 | 155 | 160 | −5 | 161 | 158 | 3 |
| BT1 | 288 | 291 | −3 | 283 | 285 | −2 |
| BT2 | 304 | 302 | 1 | 296 | 301 | −5 |

Figure 13:
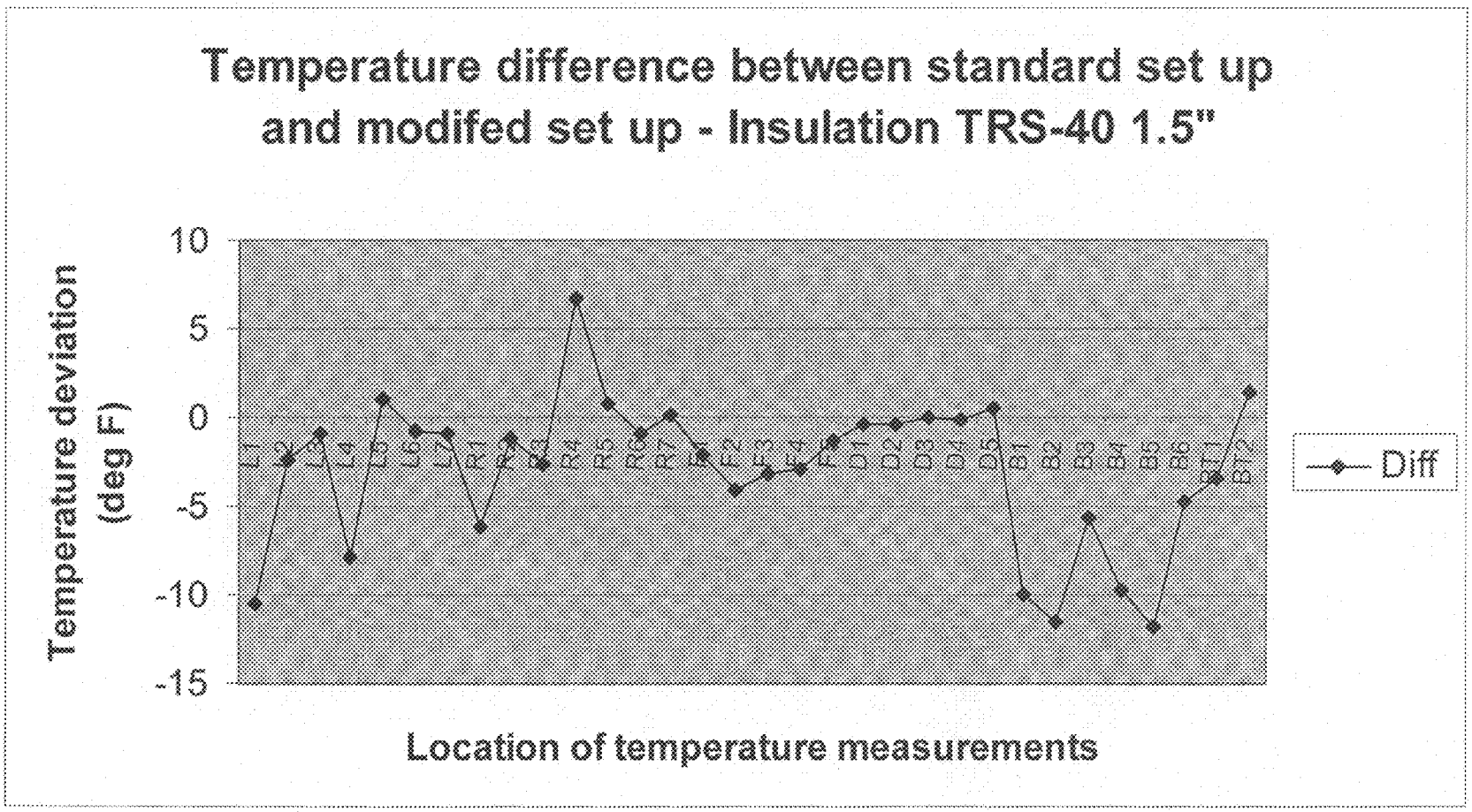
FIG. 13 is comparative graph comparing temperature differences comparing the free standing range of the present invention v. a conventional free standing range.

*TRS-40 or TRS-50 (ThermoRange ® System) Insulation manufactured by Owens Corning, Toledo, OH, USA A comparative graph comparing temperature differences using the TRS-40 insulation comparing a range set-up utilizing a chimney effect v. non-chimney effect is shown in FIG. 13.

Statistical analysis were performed on the data shown in Table 1. Two-sample T-Test and confidence interval: L1 TRS-40 w/o chimney effect, L1 TRS-40 with chimney effect were run. The results:

| | N | Mean | StDev | SE Mean |
|---|---|---|---|---|
| L1 TRS-40 w/o chimney effect | 40 | 168.902 | 0.800 | 0.12 |
| L1 TRS-40 w/chimney effect | 40 | 158.03 | 1.07 | 0.17 |

Difference = mu L1 TRS-40 WOC − mu L1 TRS-40 WC
Estimate for difference: 10.877
99% CI for difference: (10.320, 11.435)
T-Test of difference = 0 (vs not =): T-Value = 51.60 P-Value = 0.000 DF = 72

Based on the two t-tests (above) it was found that the mean temperature at location L1 (with the chimney effect) on the range was significantly and practically lower. Further analysis were run on location L2. Two-sample T-Test and confidence interval: L2 TRS-40 w/o chimney effect, L2 TRS-40 with chimney effect were run. The results:

| | N | Mean | StDev | SE Mean |
|---|---|---|---|---|
| L2 TRS-4 | 41 | 162.171 | 0.803 | 0.13 |
| L2 TRS-4 | 40 | 159.55 | 1.15 | 0.18 |

Difference = mu L2 TRS-40 WOC − mu L2 TRS-40 WC
Estimate for difference: 2.621
99% CI for difference: (2.034, 3.207)
T-Test of difference = 0 (vs not =): T-Value = 11.84 P-Value = 0.000 DF = 69

Based on the tests on L2 (above) it was found that the mean temperature at location L2 (with the chimney effect) was significantly lower.

Statistical tests were run on location L4. Two-sample T-Test and confidence interval: L4 TRS-40 w/o chimney effect, L4 TRS-40 with chimney effect were run. The results:

| | N | Mean | StDev | SE Mean |
|---|---|---|---|---|
| L4 TRS-4 | 41 | 155.049 | 0.590 | 0.092 |
| L4 TRS-4 | 40 | 147.050 | 0.639 | 0.10 |

Difference = mu L4 TRS-40 WOC − mu L4 TRS-40 WC
Estimate for difference: 7.999
99% CI for difference: (7.638, 8.360)
T-Test of difference = 0 (vs not =): T-Value = 58.54 P-Value = 0.000 DF = 78

Based on the tests on L4 (above) it was found that the mean temperature at location L4 (with the chimney effect) was significantly and practically lower.

Statistical tests were run on location R1. Two-sample T-Test and confidence interval: R1 TRS-40 w/o chimney effect, R1 TRS-40 with chimney effect were run. The results:

| | N | Mean | StDev | SE Mean |
|---|---|---|---|---|
| R1 TRs-4 | 42 | 164.000 | 0.733 | 0.11 |
| R1 TRS-4 | 40 | 157.375 | 0.897 | 0.14 |

Difference = mu R1 TRs-40 WOC − mu R1 TRS-40 WC
Estimate for difference: 6.625
99% CI for difference: (6.146, 7.104)
T-Test of difference = 0 (vs not =): T-Value = 36.53 P-Value = 0.000 DF = 75

Based on the tests on R1 (above) it was found that the mean temperature at location R1 (with the chimney effect) was significantly and practically lower.

Statistical tests were run on location R2. Two-sample T-Test and confidence interval: R2 TRS-40 w/o chimney effect, R2 TRS-40 with chimney effect were run. The results:

| | N | Mean | StDev | SE Mean |
|---|---|---|---|---|
| R2 TRS-4 | 42 | 150.167 | 0.660 | 0.10 |
| R2 TRS-4 | 40 | 148.625 | 0.705 | 0.11 |

Difference = mu R2 TRS-40 WOC − mu R2 TRS-40 WC
Estimate for difference: 1.542
99% CI for difference: (1.143, 1.940)
T-Test of difference = 0 (vs not =): T-Value = 10.22 P-Value = 0.000 DF = 78

Based on the tests on R2 (above) it was found that the mean temperature at location R2 (with the chimney effect) was significantly lower.

Figure 10:
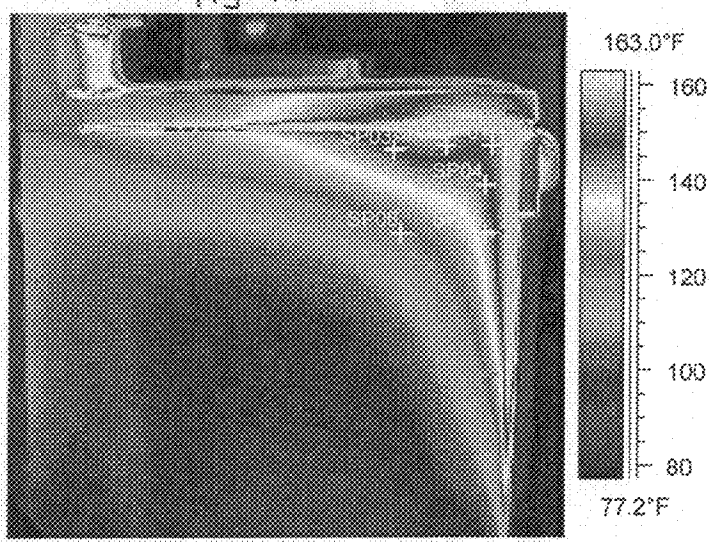
FIGS. 9-12 are infrared images of the free standing range according to the present invention.
Figure 9:
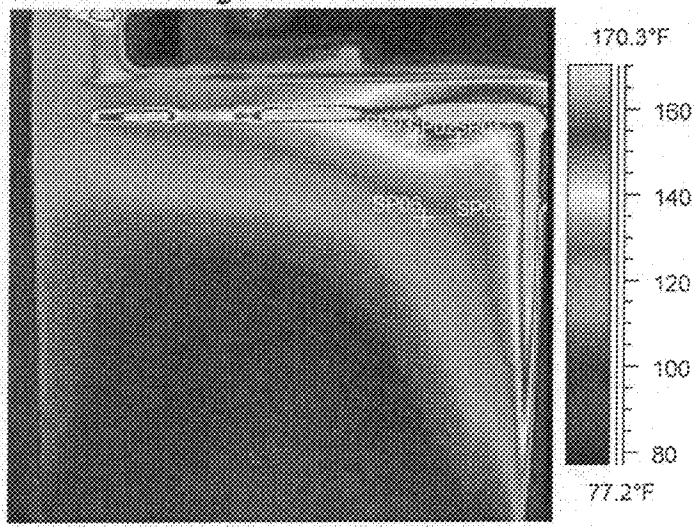

Turning to FIGS. 9 and 10, the left side of the range depicting the chimney effect (FIG. 9) v. non-chimney effect (FIG. 10). Comparative temperature values for each are shown below in Tables 2 and 3. Readings were taken at 6 locations (SP01-SP06).

TABLE 2

| Infrared Image w/chimney effect (FIG. 9) | |
|---|---|
| Label | Value (° F.) |
| SP01 | 142.1 |
| SP02 | 147.5 |
| SP03 | 145.7 |
| SP04 | 139.6 |
| SP05 | 133.3 |
| SP06 | 123.3 |

Infrared Max: >248.0° F.
Infrared Min: 74.6° F.

TABLE 3

| Infrared Image w/o chimney effect (FIG. 10) | |
|---|---|
| Label | Value (° F.) |
| SP01 | 152.4 |
| SP02 | 154.4 |
| SP03 | 143.4 |
| SP04 | 146.5 |
| SP05 | 130.3 |
| SP06 | 117.5 |

Infrared Max: >248.0° F.
Infrared Min: 72.6° F.

Figure 12:
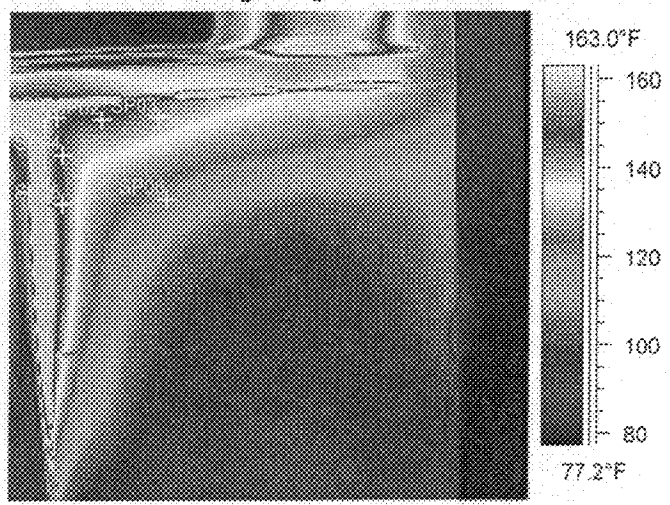
Figure 11:
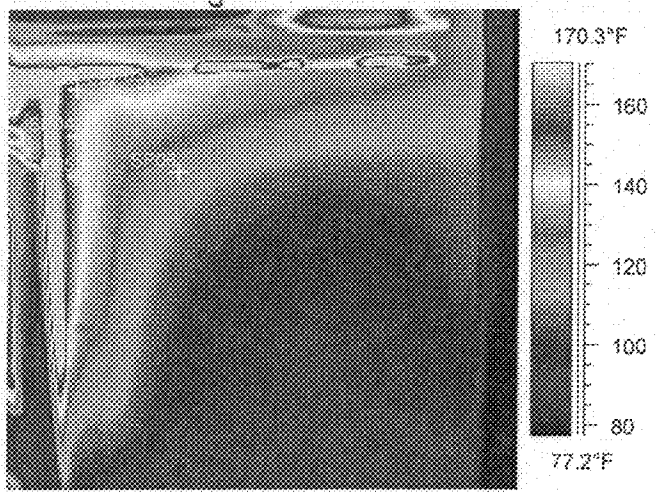

Turning to FIGS. 11 and 12, the right side of the range depicting the chimney effect (FIG. 11) v. non-chimney effect (FIG. 12). Comparative temperature values for each are shown below in Tables 4 and 5. Readings were taken at 6 locations (SP01-SP06).

TABLE 4

| Infrared Image w/chimney effect (FIG. 11) | |
|---|---|
| Label | Value (° F.) |
| SP01 | 147.0 |
| SP02 | 143.8 |
| SP03 | 145.3 |
| SP04 | 144.3 |
| SP05 | 142.1 |
| SP06 | 115.7 |

Infrared Max: >248.0° F.
Infrared Min: 75.3° F.

TABLE 5

| Infrared Image w/o chimney effect (FIG. 12) | |
|---|---|
| Label | Value (° F.) |
| SP01 | 153.7 |
| SP02 | 147.1 |
| SP03 | 137.4 |
| SP04 | 146.1 |
| SP05 | 139.5 |
| SP06 | 116.1 |

Infrared Max: >248.0° F.
Infrared Min: 74.3° F.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A kitchen range comprising:

a front panel;

a rear panel;

a pair of opposed side panels, each side panel connected to the front panel at respective front corners, and each side panel having a front flange, the front flange having a front flange portion and an inward extension portion, a portion of the side panel, the front flange portion, and the inward extension portion defining a longitudinally extending front corner and forming a channel; and a channel wall extending between the inward extension portion and the portion of the side panel and enclosing the channel to form a conduit configured to transport an airflow within the range.

2. The range defined in claim 1, wherein each of the conduits are oriented in a substantially vertical manner.

3. The range defined in claim 1, further comprising a plurality of conduits, each of the conduits being positioned along a length of the side panels.

4. The range defined in claim 3, wherein each of the plurality of conduits have different lengths.

5. The range defined in claim 3, wherein each of the plurality of conduits is positioned directly adjacent another conduit.

6. The range defined in claim 3, wherein each of the plurality of conduits is spaced apart along the length of the side panels.

7. The range defined in claim 1, wherein the channel wall is made from a metal foil material.

8. The range defined in claim 7, wherein the metal foil material has a high reflectivity on both sides of the material.

9. The range defined in claim 1, wherein the overall temperature of said range during the self-cleaning cycle is about 2.5° F. lower than a conventional range during the self-cleaning cycle.

10. The range defined in claim 1, wherein the inward extension portion is configured to connect the side panel to the front panel.

* * * * *